US006077650A

United States Patent [19]

Price

[11] Patent Number: 6,077,650

[45] Date of Patent: Jun. 20, 2000

[54] STABILIZED BLEACHING COMPOSITIONS AND METHOD OF PROCESSING COLOR ELEMENTS

[75] Inventor: Harry J. Price, Webster, N.Y.

[73] Assignee: Eastman Kodak Company, Rochester, N.Y.

[21] Appl. No.: 09/340,876

[22] Filed: Jun. 28, 1999

[51] Int. Cl.[7] ..... G03C 7/42

[52] U.S. Cl. ..... 430/461; 430/393; 430/430

[58] Field of Search ..... 430/461

[56] References Cited

U.S. PATENT DOCUMENTS

| | | | |
|---|---|---|---|
| 3,772,020 | 11/1973 | Smith | 430/393 |
| 5,002,859 | 3/1991 | Kuse et al. | 430/393 |
| 5,063,140 | 11/1991 | Kuse et al. | 430/393 |
| 5,250,401 | 10/1993 | Okada et al. | 430/393 |
| 5,352,568 | 10/1994 | Kuse et al. | 430/393 |
| 5,453,348 | 9/1995 | Kuse et al. | 430/385 |
| 5,521,056 | 5/1996 | Buchanan et al. | 430/430 |
| 5,536,625 | 7/1996 | Buchanan et al. | 430/393 |
| 5,582,958 | 12/1996 | Buchanan et al. | 430/393 |

OTHER PUBLICATIONS

JP–55067747—Abstract.
JP–51007930—Abstract.
JP–53048527—Abstract.
JP–50026542—Abstract.

*Primary Examiner*—Hoa Van Le
*Attorney, Agent, or Firm*—J. Lanny Tucker

[57] ABSTRACT

Color photographic elements can be effectively processed to provide color images using biodegradable bleaching compositions in which the bleaching agent includes a pyridinecarboxylic acid or 2,6-pyridinedicarboxylic acid chelating ligand. The bleaching composition is stabilized by incorporation of an organic amine base instead of the conventional inorganic base.

21 Claims, No Drawings

STABILIZED BLEACHING COMPOSITIONS AND METHOD OF PROCESSING COLOR ELEMENTS

FIELD OF THE INVENTION

This invention relates to a method of providing color photographic images in color photographic silver halide elements in photoprocessing. Thus, this invention relates to the photographic industry, and to photochemical processing in particular.

BACKGROUND OF THE INVENTION

The conventional image-forming process of silver halide photography includes imagewise exposure of a color photographic silver halide recording material to actinic radiation (such as visible light), and the eventual manifestation of a useable image by wet photochemical processing of that exposed material. A fundamental step of photochemical processing is the treatment of the material with one or more developing agents to reduce silver halide to silver metal. A useful color image consists of one or more images in organic dyes produced from an oxidized developing agent formed wherever silver halide is reduced to metallic silver.

To obtain useful color images, it is usually necessary to remove all of the silver from the photographic element after color development. This is sometimes known as "desilvering". Removal of silver is generally accomplished by oxidizing the metallic silver, and then dissolving it and undeveloped silver halide with a "solvent" or fixing, agent in what is known as a fixing step. Oxidation is achieved with an oxidizing agent, commonly known as a bleaching agent.

Color photographic elements can be designed to provide either color negative or color positive images. For example, color negative images can be produced by imaging and appropriate color processing of color negative films. The typical commercial processing methods for such films generally include color development, bleaching, fixing and final rinsing or stabilizing steps.

Another commercially important process intended for providing positive color images, can include the following sequence of processing steps: first (or black-and-white) development, washing, reversal reexposure, color development, bleaching, fixing, washing and/or stabilizing. Another useful process has the same steps, but stabilizing is carried out between color development and bleaching. Such conventional steps are described, for example, in U.S. Pat. No. 4,921,779 (Cullinan et al), U.S. Pat. No. 4,975,356 (Cullinan et al), U.S. Pat. No. 5,037,725 (Cullinan et al), U.S. Pat. No. 5,523,195 (Darmon et al) and U.S. Pat. No. 5,552,264 (Cullinan et al) for the processing of color reversal films.

The most common bleaching agents for color photographic processing are complexes of ferric ion and various organic chelating ligands (such as aminopolycarboxylic acids), of which there are hundreds of possibilities, all with varying bleaching activities and biodegradability. Common organic chelating ligands used as part of bleaching agents for color film processing include ethylenediamine-tetraacetic acid (EDTA), 1,3-propylenediaminetetraacetic acid (PDTA) and nitrilotriacetic acid (NTA).

U.S. Pat. No. 4,294,914 (Fyson) describes bleaching and bleach-fixing compositions and a processing method using a ferric complex of one of several alkyliminodiacetic acids, which are known to be more biodegradable than other common organic chelating ligands such as EDTA. Other bleaching agents using similar organic chelating ligands are described in U.S. Pat. No. 5,061,608 (Foster et al) in which the bleaching agent is advantageously combined with specific aliphatic carboxylic acids to reduce dye stains. U.S. Pat. No. 5,334,491 (Foster et al) also describes the use of similar biodegradable bleaching agents in combination with specific levels of bromide ion.

The use of biodegradable bleaching agents is becoming more important as governmental regulators and photochemical users become more aware of the need to reduce the impact on the environment. There is considerable literature relating to such bleaching agents, including ferric complexes of methyliminodiacetic acid (MIDA) and similar compounds. Bleaching compositions containing iron complexes of MIDA and other biodegradable ligands have been used successfully for processing color negative films.

JP Kokai 5-26542 describes a bleaching solution containing an iron chelate and 2-carboxypyridine. Other literature describes the use of uncomplexed heterocyclic compounds such as pyridine-2,6-dicarboxylic acid in processing solutions. U.S. Pat. No. 5,536,625 (Buchanan et al) describes the use of ferric ion complexes of such heterocyclic compounds as peracid bleaching accelerators. Ternary complexes comprising the heterocyclic compounds are similarly described in U.S. Pat. No. 5,521,056 (Buchanan et al).

The same ternary complexes are used as bleaching agents in U.S. Pat. No. 5,582,958 (Buchanan et al) wherein one of the ligands complexed to ferric ion is for example pyridinecarboxylic acid (PCA) or 2,6-pyridinedicarboxylic acid (PDCA). Such chelating ligands are also biodegradable, making them even more attractive for photographic processing compositions.

It has been observed, however, that a possible problem arising with the use of such biodegradable chelating ligands is that precipitates tend to form in bleaching compositions containing such ligands after storage for several days. In other words, the shelf stability of the bleaching compositions is too short. Precipitate formation is undesirable for a number of reasons including that it can cause deposits on processing equipment, it changes the concentration of the remaining components in the solution, and it can require filtration steps.

Thus, there is a need to provide bleaching compositions containing biodegradable ligands such as pyridinecarboxylic acids that have increased shelf stability.

SUMMARY OF THE INVENTION

The problems with known photographic photoprocessing compositions and methods are overcome with the use of a photographic bleaching composition comprising:

a) at least 0.01 mol/l of a bleaching agent that comprises ferric ion chelated with a first chelating ligand comprising an aromatic nitrogen heterocycle, and b) at least 0.01 mol/l of an organic amine base, the bleaching composition being substantially free of inorganic bases and the molar ratio of the organic amine base to the first chelating ligand being at least 1:1.

This invention also provides a method of photographic processing comprising bleaching an imagewise exposed and color developed photographic silver halide element with the bleaching composition described above.

The advantages of this invention are several. The color photographic elements can be processed using more environmentally acceptable bleaching compositions. In other words, more biodegradable bleaching compositions can be used, particularly those including ferric complexes of PCA and PDCA or similar chelating ligands as bleaching agents.

Previously, bleaching composition containing such bleaching agents have formed precipitates upon storage for several days. When the bleaching agents are prepared, the chelating ligands are usually supplied in an acid form and must normally be neutralized using a base. I discovered that if the base used for neutralization is an organic amine instead of a conventional inorganic base, precipitation is considerably reduced and shelf life is significantly increased.

In addition, where ternary bleaching agents are used, in some instances, the amount of the second chelating ligand can be reduced because of the presence of the organic amine base. One such example of a useful ternary complex in which this advantage was observed is a ferric complex of PDCA and NTA.

DETAILED DESCRIPTION OF THE INVENTION

The method of this invention can be used to provide a color positive or negative image in what are known in the art as color reversal or negative photographic elements. After such elements are imagewise exposed and subjected to at least color development, they are bleached and fixed to remove silver, and otherwise processed using conventional steps and compositions.

Photographic bleaching is carried out in a bleaching step using one or more bleaching agents that are ferric complexes of one or more aminopolycarboxylic acid or polycarboxylic acid chelating ligands. The resulting ferric ion complexes can be binary complexes, meaning the ferric ion is complexed to one or more molecules of the same chelating ligand, or ternary complexes in which the ferric ion is complexed to molecules of two distinct chelating ligands, similar to those complexes described for example in U.S. Pat. No. 5,670,305 (Gordon et al) and U.S. Pat. No. 5,582,958 (noted above). A mixture of multiple binary or ternary ferric ion complexes also can be present in the bleaching composition providing multiple ferric bleaching agents. Preferably, the chelating ligands used in this manner are biodegradable. There may also be present a small quantity of non-biodegradable bleaching agents, of which there are hundreds of possibilities known in the art. Typically such bleaching agents comprise nonbiodegradable chelating ligands and may be present in the bleaching compositions in an amount of less than 0.1 mol/l.

The essential first chelating ligands used to prepare bleaching agents useful in this invention are aromatic chelating ligands that include substituted or unsubstituted 2-pyridinecarboxylic acids and substituted or unsubstituted 2,6-pyridinedicarboxylic acids (or equivalent salts). The substituents that may be on the pyridinyl ring include substituted or unsubstituted alkyl (for example having up to 10 carbon atoms), substituted or unsubstituted cycloalkyl (for example 5 to 7 carbon atoms in the ring) or substituted or unsubstituted aryl groups (for example substituted or unsubstituted phenyl and naphthyl), hydroxy, nitro, sulfo, amino, carboxy, sulfamoyl, sulfonamide, phospho, halo or any other group that does not interfere with ferric ion complex formation, stability, solubility or catalytic activity. The substituents can also be the atoms necessary to form a 5- to 7-membered fused ring with the pyridinyl nucleus.

The preferred first chelating ligands are represented by the following structures I and II:

(I)

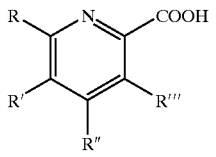

and (II)

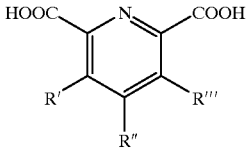

wherein R, R', R" and R'" are independently hydrogen, a substituted or unsubstituted alkyl of 1 to 5 carbon atoms, substituted or unsubstituted aryl group of 6 to 10 carbon atoms, a substituted or unsubstituted cycloalkyl of 5 to 10 carbon atoms, hydroxy, nitro, sulfo, amino, carboxy, sulfamoyl, sulfonamido, phospho or halo (such as chloro or bromo), or any two of R, R', R" and R'" can comprise the carbon atoms necessary to form a substituted or unsubstituted 5 to 7-membered ring fused with the pyridinyl nucleus.

Preferably, R, R', R" and R'" are independently hydrogen, hydroxy or carboxy. The most preferred chelating ligands are unsubstituted 2-pyridinecarboxylic acid and 2,6-pyridinedicarboxylic acid.

It should be understood that salts of these compounds are equally useful. Useful aromatic carboxylic acids and their salts are also described in various publications, including Japanese Kokai 51-07930, EP-A-0 329 088 and *J. Chem. Soc. Dalton Trans.,* 619 (1986).

These first chelating ligands can be obtained from a number of commercial sources or prepared using conventional procedures and starting materials [see for example, Syper et al, *Tetrahedron,* 36, 123-129, 1980 and Bradshaw et al, *J. Am. Chem. Soc.,* 102(2), 467-74, 1980].

While binary complexes are useful as bleaching agents, the bleaching agents used in this invention can also be ternary complexes comprising a second chelating ligand that is a biodegradable aminopolycarboxylic acid or polycarboxylic acid (or an equivalent salt thereof).

There are many known classes of biodegradable second aminopolycarboxylic acid or polycarboxylic acid chelating ligands that can be used to form biodegradable ferric ion bleaching agents. A preferred class of second chelating ligands includes iminodiacetic acid and its derivatives (or salts thereof). Preferred second chelating ligands are alkyliminodiacetic acids that have a substituted or unsubstituted alkyl group having 1 to 6 carbon atoms (such as methyl, ethyl, n-propyl, isopropyl and t-butyl). Particularly useful alkyliminodiacetic acids are methyliminodiacetic acid (MIDA) and ethyliminodiacetic acid (EIDA), and MIDA is the most preferred. These ligands can be used in the free acid form or as alkali metal (for example, sodium and potassium) or ammonium salts. These and other second chelating ligands of this class can be represented by Structure III:

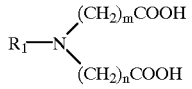

wherein m and n are independently 1, 2 or 3, and preferably each is 1. $R_1$ is hydrogen, a substituted or unsubstituted alkyl group (having 1 to 10 carbon atoms), a substituted or unsubstituted aryl groups (having 6 to 10 carbon atoms in the aromatic ring), or a substituted or unsubstituted heterocyclic group having from 5 to 10 carbon and heteroatoms (nitrogen, sulfur or oxygen). Preferably, $R_1$ is hydrogen or a substituted or unsubstituted alkyl group having 1 to 3 carbon atoms, and more preferably, it is hydrogen, methyl or ethyl.

Substituents that can be present in the alkyl, aryl and heterocyclic group include any monovalent moiety that does not bind to ferric ion, such as alkoxy (having 1 to 6 carbon atoms), amino, carboxy, phosphono, sulfo, —$SR_2$, —$CONR_3R_4$, and others readily apparent to one skilled in the art, wherein $R_2$ through $R_4$ independently represent hydrogen or a substituted or unsubstituted alkyl group as described above for $R_1$.

Useful second chelating ligands within the scope of Structure III include:

1.

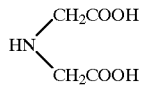

2.

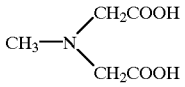

3.

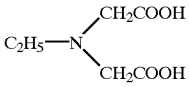

4.

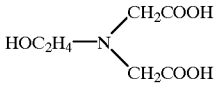

5.

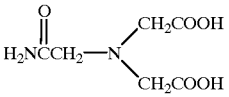

6.

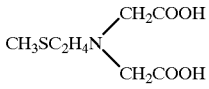

7.

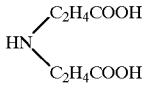

8.

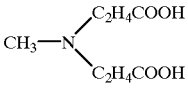

-continued

9.

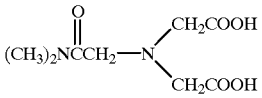

Another class of biodegradable second chelating ligands useful to form bleaching agents can be represented by Structure IV:

IV

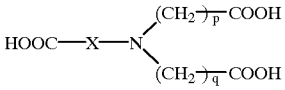

wherein p and q are independently 1, 2 and 3, and preferably each is 1. The linking group X may be any divalent group that does not bind ferric ion and does not cause the resulting ligand to be water-insoluble. Preferably, X is a substituted or unsubstituted alkylene group, substituted or unsubstituted arylene group, substituted or unsubstituted arylenealkylene group, or substituted or unsubstituted alkylenearylene group. If substituted, such substituents can be those defined above for the ligands of Structure III. Preferably, X is a substituted or unsubstituted alkylene group of 1 to 3 carbon atoms. These ligands can also be used in the form of alkali metal or ammonium salts.

Representative second chelating ligands within the scope of Structure IV include:

1.

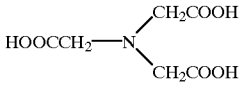

2.

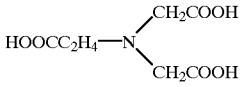

3.

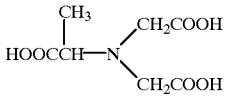

4.

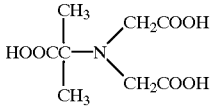

5.

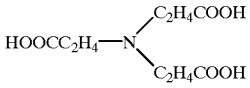

6.

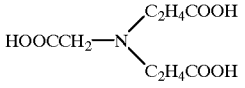

Still another useful class of biodegradable second chelating ligands are aminodisuccinic and aminomonosuccinic acids (or salts thereof). Aminodisuccinic acids are compounds having one or more nitrogen atoms (preferably two or more nitrogen atoms) and preferably two of the nitrogen atoms are bonded to a succinic acid group (or salt thereof).

Preferred chelating ligands have at least two nitrogen atoms, preferably no more than ten nitrogen nitrogen atoms (not attached to a succinic acid group) are preferably substituted with hydrogen atoms only, but other substituents can also be present. Most preferably, the succinic acid group(s) are attached to terminal nitrogen atoms (meaning first or last nitrogens in the compounds). More details about such chelating ligands including representative chelating ligands are provided in U.S. Pat. No. 5,652,085 (Wilson et al), incorporated herein by reference. Ethylenediamine-N,N'-disuccinic acid (EDDS) is most preferred in this class of compounds. All isomers are useful, including the [S,S] isomer, and the isomers can be used singly or in mixtures.

Aminomonosuccinic acids (or salts thereof) are compounds having at least one nitrogen atom to which a succinic acid (or salt) group is attached. Otherwise, the compounds are defined similarly to the aminodisuccinic acids described above. U.S. Pat. No. 5,652,085 (noted above) also provides more details about such compounds, particularly the polyamino monosuccinic acids. Ethylenediamine monosuccinic acid (EDMS) is preferred in this class of chelating ligands.

Mixtures of bleaching agents that are ferric ion binary or ternary complexes of EDDS and EDMS are also useful in the practice of this invention.

Still other useful biodegradable second chelating ligands include, but are not limited to, alaninediacetic acid, β-alaninediacetic acid (ADA), nitrilotriacetic acid (NTA), glycinesuccinic acid (GSA), 2-pyridylmethyliminodiacetic acid (PMIDA), citric acid and tartaric acid.

Where ternary complexes are used as bleaching agents in the preferred embodiments of this invention, the mol ratio of the first chelating ligand to ferric ion is generally at least 0.6:1 (preferably from about 0.8:1 to about 2:1), and the mol ratio of the second chelating ligand to ferric ion is at least 0.2:1 (preferably from about 0.5:1 to about 2:1).

Preferred ternary bleaching agents are ferric ion complexes of methyliminodiacetic acid (MIDA) and 2,6-pyridinedicarboxylic acid (PDCA), and nitrilotriacetic acid (NTA) and PDCA.

One preferred embodiment is a ternary complex of ferric ion with PDCA and NTA wherein the mol ratio of NTA to ferric ion is from about 0.5:1 to about 1:1.

The iron salts used to form bleaching agents in the practice of this invention are generally ferric ion salts which provide a suitable amount of ferric ion for complexation with the ligands defined below. Useful ferric salts include, but are not limited to, ferric nitrate nonahydrate, ferric ammonium sulfate, ferric oxide, ferric sulfate and ferric chloride. Ferric nitrate is preferred. These salts can be provided in any suitable form and are available from a number of commercial sources.

As used herein, the terms "biodegradable" and "biodegradability" refer to at least 80% decomposition in the standard test protocol specified by the Organization for Economic Cooperation and Development (OECD), OECD 301B "Ready Biodegradability: Modified Sturm Test" which is well known in the photographic processing art.

It is not necessary that the ferric ion and the chelating ligand(s) be present in the bleaching composition in stoichiometric proportions. It is preferred, however, that the molar ratio of the total chelating ligands to ferric iron be from about 1:1 to about 5:1. In a more preferred embodiment, the ratio is about 1:1 to about 2.5:1 moles of total chelating ligands per mole of ferric ion.

Generally speaking, ferric ions are present in the bleaching composition in an amount of at least 0.01 mol/l, and preferably at least 0.1 mol/l, and generally up to 1 mol/l, and preferably up to 0.4 mol/l.

The bleaching agents are generally provided for the present invention by mixing a ferric ion compound (typically a water-soluble salt) with the desired chelating ligands in an aqueous solution. The pH of the solution is adjusted using appropriate acids or bases.

An essential component of the bleaching composition is an organic amine base (or mixture thereof). Such compounds are generally primary, secondary or tertiary amines having one or more substituted or unsubstituted alkyl groups (having 1 to 6 carbon atoms), substituted or unsubstituted cycloalkyl groups (having 5 to 10 carbon atoms), or substituted or unsubstituted aryl groups (having 6 to 10 carbon atoms in the ring structure) attached to one or more nitrogen atoms. Such substituents can be further substituted, for example, with hydroxy groups (such as hydroxyalkyl groups). The amines can have more than one amino moiety in the molecule. That is they can be diamines or triamines. In addition, they can be cyclic amines.

In general, the organic amines useful in this invention must have a water solubility of at least 0.01 mol/l, and preferably they have a water solubility of at least 0.1 mol/l.

Particularly useful amines useful as bases in this invention include, but are not limited to, ethanolamine, diethanolamine, triethanolamine, diethylamine, triethylamine, ethylenediamine, tetramethylethylenediamine, 2-methylaminoethanol, morpholine, and piperazine. Preferred amines include ethanolamine, diethanolamine and triethanolamine, and ethanolamine is most preferred.

These amines are generally present in the bleaching composition in an amount of at least 0.01 mol/l, and preferably at least 0.1 mol/l. The upper limit is generally up to 3 mol/l, and preferably up to 1.5 mol/l. These concentrations are for working strength solutions, but one skilled in the art would understand that concentrates would have higher concentrations of the amines depending upon desired dilution rate. The molar ratio of the organic amine base to the second chelating ligand is at least 1:1.

In preferred embodiments, a rehalogenating agent, such as chloride or bromide ions, is also present in the bleaching composition. The rehalogenating agent can be present in any effective amount, with useful amounts typically being at least about 0.1 mol/l, and preferably at least about 0.2 mol/l. Bromide ions are preferred, especially when the emulsions being processed are predominantly silver bromide. Chloride or bromide ions are generally provided as hydrochloric acid or hydrobromic acid, but they could also be provided in the form of salts.

The bleaching composition can also include other addenda that may be useful in either working strength bleaching solutions5 replenish5 replenishers or regenerators, such as buffers, optical brighteners, whitening agents, preservatives (such as sulfites), metal sequestering agents, anti-scumming agents, organic antioxidants, biocides, anti-fungal agents, and anti-foam agents.

Useful buffers include acetic acid, propionic acid, succinic acid, maleic acid, malonic acid, tartaric acid, and other water-soluble aliphatic or aromatic carboxylic acids known in the art. Acetic acid and succinic acid are preferred. Inorganic buffers, such as borates, hydrobromic acid and carbonates can be used if desired. The bleaching compositions are aqueous acidic solutions preferably having a pH of from about 2 to about 6, but a different pH can be used if desired. A preferred pH is in the range of from about 3.5 to about 5.5. Alternatively, the compositions can be formulated as dry powders, granules or tablets that upon dissolution in water have the noted pH.

The bleaching compositions of this invention can also be bleach-fixing compositions that include one or more fixing agents as well as the noted bleaching agents. Useful fixing agents are described below. Preferably, however, the bleaching compositions contain no photochemically active amount of a fixing agent, and thusly are not considered bleach-fixing compositions.

A fixing composition is used at least after the bleaching step. If desired, more than one fixing step can be used, and one or more of those steps can precede the bleaching step as long as one fixing step follows the bleaching step. One or more intermediate washing steps can separate the bleaching and fixing steps if desired.

A useful photographic fixing composition is an aqueous composition containing one or more photographic fixing agents, with or without fixing accelerators. Useful fixing agents include, but are not limited to, sulfites, thiocyanates, thiosulfates, and mixtures thereof. Fixing accelerators include, but are not limited to, thioethers, and mercaptotriazoles. The fixing agents can be present as thiosulfate or thiocyanate salts (that is alkali metal or ammonium salts) as is well known in the art. Mixtures of at least one thiosulfate and at least one thiocyanate may be particularly useful in some methods of the invention, especially when more rapid fixing is desired.

The fixing solution can include other addenda commonly useful in such solutions for various purposes, including buffers, metal sequestering agents, and electron transfer agents. Preferably, the fixing composition includes one or more uncomplexed aminodisuccinic acids that have one or more nitrogen atoms, and one or more of the nitrogen atoms are bonded to one or two succinic acid groups (or salts thereof) as described in copending and commonly assigned U.S. Ser. No. 09/283,396, filed Apr. 1, 1999 by myself. Such compounds include both monoamino disuccinic acids (or salts thereof) and polyamino disuccinic acids (or salts thereof) as described above for the second chelating ligand.

Such compounds have at least two nitrogen atoms, preferably no more than ten nitrogen atoms, and more preferably, no more than 6 nitrogen atoms. The remaining nitrogen atoms (not attached to a succinic acid group) are preferably substituted with hydrogen atoms only, but other substituents can also be present. Most preferably, the succinic acid group(s) are attached to terminal nitrogen atoms (meaning first or last nitrogens in the compounds). More details about such compounds and their preparation are provided in U.S. Pat. No. 5,652,085 (noted above).

Representative compounds of this type that are used as uncomplexed "additives" in the fixing composition include, but are not limited to, ethylenediamine-N,N'-disuccinic acid (EDDS), diethylenetriamine-N,N"-disuccinic acid, triethylenetetraamine-N,N'"-disuccinic acid, 1,6-hexamethylenediamine-N,N'-disuccinic acid, tetraethylenepentamine-N,N""-disuccinic acid, 2-hydroxypropylene-1,3-diamine-N,N'-disuccinic acid, 1,2-propylenediamine-N,N'-disuccinic acid, 1,3-propylenediamine-N,N'-disuccinic acid, cis-cyclohexanediamine-N,N'-disuccinic acid, trans-cyclohexanediamine-N,N'-disuccinic acid, ethylenebis(oxyethylenenitrilo)-N,N'-disuccinic acid, methyliminodisuccinic acid, and iminodisuccinic acid (IDSA). EDDS and IDSA are preferred. Racemic mixtures of the uncomplexed additives can be used, or essentially pure isomers can be used. For example, the [S,S] isomer of EDDS may be useful in the practice of this invention.

Other uncomplexed biodegradable or non-biodegradable polycarboxylic acids (for example, citric acid, nitrilotriacetic acid, tartaric acid, or ethylenediaminetetraacetic acid) can be included in the fixing composition as well as long as sufficient aminodisuccinic acid(s) are present to achieve the desired reduction in residual iron during fixing.

The amount of the one or more uncomplexed aminodisuccinic acids present in the fixing composition is at least 0.01 mol/l, and preferably at least 0.03 mol/l. The upper amount is generally 0.2 mol/l, and preferably 0.1 mol/l.

The amount of fixing agent useful in the fixing composition is well known in the art, and is generally at least 0.5 mol/l. Other details about fixing solutions are also well known in the art to a skilled photographic processing chemist. The compositions can include but are not limited to, buffers, biocides, anti-fungal agents, optical brighteners, preservatives (such as sulfites), organic antioxidants, anti-scumming agents, and sequestering agents.

The bleaching compositions of this invention can be used to process a suitable photographic element using any suitable processing equipment and conditions including conventional processing equipment and conditions (such as large processors or minilab processors). Generally, the processing equipment includes a series of tanks containing the various processing solutions in sequence. In most of such processing apparatus, the processed materials are generally immersed in the processing solutions. The volumes of the processing solutions can vary from less than 100 ml to 50 liters. Such processing equipment may also include rollers to guide the photographic material through the various processing tanks.

The bleaching compositions of this invention can be used as working tank solutions or replenishers, and can be in diluted or concentrated form for use as a regenerator and/or replenisher. The fixing solutions described above can be similarly prepared and used. Both solutions can be replenished at a replenishment rate of up to 1000 ml/m$^2$. Replenishment can be accomplished directly into the processing tank, or a portion of overflow can be mixed with a regenerator to provide a suitable regenerated replenisher. The regenerator concentrate itself can be delivered directly to the processing tank.

Bleaching according to this invention can be carried out in less than 8 minutes, but even shorter times are possible under certain conditions. For example, the time may be within 6 minutes, and more preferably within 5 minutes. Bleaching temperatures are generally from about 20 to about 50° C.

Fixing can be carried out within 4 minutes, and even shorter times may be desirable under certain conditions. Fixing temperatures can generally be from about 20 to about 50° C.

Each of the bleaching and fixing steps can be carried out in one or more tanks or stages arranged in countercurrent or concurrent flow. Any fixing method can be used, including immersing the element in the fixing composition (with or without agitation or circulation), bringing the element into contact with a web or drum surface that is wet in such a way that the fixing composition is brought into contact with the element, or by applying the fixing composition to the element by high velocity jet or spray.

During fixing, the fixing composition in the processor may accumulate dissolved silver halide, and other substances that are extracted from the processed photographic element. Such materials, and particularly silver halide, can be removed using known means, such as ion exchange, electroysis, electrodialysis and precipitation.

Color photographic elements are also subjected to several other processing steps and compositions in order to provide the desired color image. The details of such processing steps and compositions are well known. For example, color reversal processing may include first development, a reversal step, color development, pre-bleaching or conditioning, post-fixing stabilizing, and the color photographic elements processed therein, including emulsions, supports and other details thereof, are well known from hundreds of publications, some of which are listed in *Research Disclosure,* publication 38957, pages 592–639, September 1996, incorporated herein by reference. *Research Disclosure* is a publication of Kenneth Mason Publications Ltd., Dudley House, 12 North Street, Emsworth, Hampshire PO10 7DQ England.

Since the bleaching and fixing steps are separate steps in an overall image-forming method of this invention, any processing sequence can be used for processing the color reversal elements. For example, two conventional processing methods are known as Process E-6 and Process K- 14 for color reversal films.

Process C-41 is a well known processing method for color negative films, and Process RA is a well known processing method for color papers.

Preferably, the present invention is carried out to provide color positive images using a typical sequence of steps including first development (black-and-white development), a reversal processing step, color developing, bleaching, fixing, and stabilizing. There may be various washing steps between other steps, as well as a pre-bleach step or conditioning step before bleaching. Alternatively, stabilizing can occur between color developing and bleaching.

Many details of such processes are provided in U.S. Pat. No. 5,552,264 (Cullinan et al), incorporated herein by reference. Other details are provided in *Research Disclosure,* publication 38957 (noted above), and references noted therein.

Color reversal films used in the practice of this invention are comprised of a support having thereon a plurality of photosensitive silver halide emulsion layers that can contain any conventional silver halide (or mixture thereof). Such films generally have silver halide emulsions having at least 1 mol % iodide based on total silver.

Useful supports are well known and include polyester films, polycarbonate films and cellulose acetate films. The silver halide layers include conventional binder materials, and other conventional addenda. Some specific commercially available color reversal photographic films that can be processed using this invention include EKTACHROME and KODACHROME Color Reversal Films (Eastman Kodak Company), FUJICHROME Color Reversal Films (Fuji Photo Film Co., Ltd.), AGFACHROME Color Reversal Films (AGFA), KONICACHROME Color Reversal Films (Konica) and SCOTCHCHROME Color Reversal Films (Imation).

Color reversal films particularly useful in the practice of this invention include those containing what are known as arylpyrazolone type of magenta dye forming color couplers. Such color couplers are well known in the art. One such compound is described in U.S. Pat. No. 5,037,725 (Cullinan et al).

A black-and-white composition used in the first development generally includes one or more black and white developing agents (such as dihydroxybenzenes or derivatives thereof, ascorbic acid or derivatives thereof, aminophenol and 3-pyrazolidone type developing agents) that are well known in the art, including U.S. Pat. No. 5,187,050 (Yamada et al), U.S. Pat. No. 5,683,859 (Nothnagle et al),U.S. Pat. No. 5,683,859 (noted above) and U.S. Pat. No. 5,702,875 (Opitz et al), all incorporated herein by reference.

Photographic reversal compositions are also known in the art, including for example U.S. Pat. No. 3,617,282 (Bard et al) and U.S. Pat. No. 5,736,302 (Buongiorne et al), both incorporated herein by reference.

The color development is generally accomplished with a color developing composition containing the chemical components conventionally used for that purpose, including color developing agents, buffering agents, metal ion sequestering agents, optical brighteners, halides, antioxidants, sulfites and other compounds readily apparent to one skilled in the art. Examples and amounts of such components are well known in the art, including for example U.S. Pat. No. 5,037,725 (Cullinan et al) and U.S. Pat. No. 5,552,264 (Cullinan et al), both incorporated herein by reference.

Another useful composition for color reversal processing is a composition that provides dye image stabilization. If in liquid form, this composition generally includes a dye stabilization compound (such as an alkali metal formaldehyde bisulfite, hexamethylenetetramine and various formaldehyde releasing compounds), buffering agents, bleach-accelerating compounds, secondary amines, preservatives, and metal sequestering agents. All of these compounds are well known in the art, including U.S. Pat. No. 4,839,262 (Schwartz), U.S. Pat. No. 4,921,779 (Cullinan et al), U.S. Pat. No. 5,037,725 (Cullinan et al), U.S. Pat. No. 5,523,195 (Darmon et al) and U.S. Pat. No. 5,552,264 (Cullinan et al), all incorporated herein by reference.

A final rinse composition generally has a pH of from about 5 to about 9 (in liquid form), and can include one or more surfactants (anionic, nonionic or both), biocides and buffering agents as is well known in the art. See for example, U.S. Pat. No. 3,545,970 (Giorgianni et al), U.S. Pat. No. 5,534,396 (McGuckin et al), U.S. Pat. No. 5,645,980 (McGuckin et al), U.S. Pat. No. 5,667,948 (McGuckin et al) and U.S. Pat. No. 5,716,765 (McGuckin et al), all of which are incorporated herein by reference.

All of the compositions useful in the practice of this invention can be provided in either working strength or concentrated form. If in the form of concentrates, suitable dilution before or during use would be readily apparent to one skilled in the art.

The following examples are provided to illustrate the invention, and not to be limiting in any fashion.

EXAMPLES 1–9

Evaluation of Various Organic Amines

Several bases were evaluated in bleaching compositions prepared by mixing 2,6-pyridinedicarboxylic acid (0.03 mol) in water (40 ml) with slight heating, followed by 0.05 mol of the individual base. Ferric nitrate (0.015 mol, 39% solution) was then added to form a binary ferric ion complex. Water was added to make a total of 100 ml. Each composition was allowed to stand at room temperature for ten days and was then examined for the formation of precipitates. TABLE I below shows the various bases used in this example, and any observed precipitation after the ten days.

TABLE I

| COMPOSITION | BASE | RESULTS |
|---|---|---|
| Control A | Potassium hydroxide | Considerable precipitation |
| Control B | Sodium hydroxide | Considerable precipitation |
| Example 1 | Ethanolamine | No precipitation |
| Example 2 | Triethanolamine | No precipitation |
| Example 3 | Ethylenediamine | Slight precipitation |
| Example 4 | Diethylamine | No precipitation |
| Example 5 | Morpholine | No precipitation |
| Example 6 | Tetramethylethylenediamine | No precipitation |
| Example 7 | Piperazine | Slight precipitation |
| Example 8 | Diethanolamine | No precipitation |
| Example 9 | 2-Methylaminoethanol | No precipitation |

It can be seen that the various organic amine bases used in the noted compositions prohibited precipitation or allowed only slight precipitation to occur in comparison to the two inorganic bases.

EXAMPLES 10–11

Preparation & Evaluation of Bleaching Compositions Containing Ternary Bleaching Agents Four additional bleaching compositions were prepared and evaluated for precipitate formation after standing at room temperature for 14 days. TABLE II below shows the components in each composition in the order of addition, and the results of the evaluation.

TABLE II

| COMPONENT | CONTROL C | EXAMPLE 10 | CONTROL D | EXAMPLE 11 |
|---|---|---|---|---|
| Water | 200 ml | 100 ml | 500 ml | 200 ml |
| Potassium hydroxide | 299.2 g | 0 | 0 | 0 |
| 2,6-Pyridine-dicarboxylic acid | 50.14 g | 0 | 42.59 g | 42.6 g |
| Ethanolamine | 0 | 146.64 g | 0 | 0 |
| 2,6-Pyridine-dicarboxylic acid | 0 | 50.14 g | 0 | 0 |
| Nitrilotriacetic acid | 28.66 g | 28.66 g | 0 | 0 |
| Morpholine | 0 | 0 | 0 | 97.5 g |
| Potassium hydroxide (45%) | 0 | 0 | 66.98 g | 0 |
| Potassium salt of methylimino-diacetic acid (49.6%) | 0 | 0 | 242.87 g | 243 g |
| Hydrobromic acid (48%) | 168.54 g | 168.54 g | 0 | 101.2 g |
| Potassium bromide | 0 | 0 | 71.38 g | 0 |
| Acetic acid | 30 g | 30 g | 0 | 0 |
| Succinic acid | 0 | 0 | 58.99 g | 59 g |
| Ferric nitrate (39%) | 184.5 g | 184.5 g | 184.5 g | 184.5 g |
| Potassium carbonate or nitric acid | to pH 4.0 | 0 | to pH 3.9 | 0 |
| Ethanolamine or nitric acid | 0 | to pH 4.0 | 0 | 0 |
| Morpholine or nitric acid | 0 | 0 | 0 | to pH 3.9 |
| Water | to make 1 liter | to make 1 liter | to make 1 liter | to make 1 liter |
| Results | Considerable precipitation | No precipitation | Considerable precipitation | No precipitation |

EXAMPLES 12–13

Evaluation of Bleaching Compositions

Two additional bleaching compositions of this invention were prepared having the components shown in TABLE III in the order of addition. The concentration of the bleaching agent in each composition was 0.15 mol/l.

TABLE III

| COMPONENT | EXAMPLE 12 | EXAMPLE 13 |
|---|---|---|
| Water | 20 ml | 20 ml |
| Diethanolamine | 16.8 g | 0 |
| Tetramethylethylenediamine | 0 | 9.4 g |
| 2,6-Pyridinedicarboxylic acid | 5.01 g | 5.01 g |
| Hydrobromic acid (48%) | 8.4 g | 8.4 g |
| Succinic acid | 3.0 g | 3.0 g |
| Ferric nitrate (39%) | 9.23 g | 9.23 g |
| Nitric acid | to pH 4.0 | to pH 4.0 |
| Water | to 100 ml | to 100 ml |

These two compositions were tested for bleaching activity by pumping them through a flow cell containing small samples of uniformly exposed KODAK EKTACHROME ELITE II 100 Color Reversal Film that had been processed previously using conventional Process E-6 first development, reversal bath, color development and pre-bleaching steps. The bleaching activity was monitored using a conventional spectrophotometer to follow the loss in absorbance of metallic silver at 1100 nm.

It was observed that the Example 12 composition completely bleached the film sample in 4.6 minutes, and the Example 13 composition completely bleached the film sample in 3.7 minutes.

Each composition was also allowed to stand at room temperature for two weeks. No precipitation was observed in either composition after that time.

EXAMPLE 14

Processing Color Reversal Films

Samples of commercially available KODAK EKTACHROME ELITE II 100 Color Reversal Film were given a conventional 21-step exposure. These film samples were then processed using conventional Process E-6 conditions, processing sequence (TABLE IV) and processing solutions, except for bleaching composition (described in Example 10 above).

TABLE IV

| PROCESSING STEP | PROCESSING COMPOSITION | PROCESSING TIME | PROCESSING TEMPERATURE |
|---|---|---|---|
| First Development | KODAK First Developer, Process E-6 | 360 seconds | 37° C. |
| Washing | Water | 120 seconds | 37° C. |
| Reversal bath | KODAK Process E-6 AR Reversal Bath & Replenisher | 120 seconds | 37° C. |
| Color development | KODAK Color Developer, Process E-6 | 360 seconds | 38° C. |
| Prebleaching | KODAK Prebleach Replenisher II, Process E-6 | 120 seconds | 37° C. |
| Bleaching | see Example 10 | 360 seconds | 37° C. |
| Fixing | KODAK Fixer, Process E-6 | 240 seconds | 37° C. |
| Washing | Water | 240 seconds | 37° C. |
| Final rinsing | KODAK Final Rinse & Replenisher, Process E-6AR | 60 seconds | 37° C. |

The film samples were successfully processed to provide color positive images using the processing compositions described above including the bleaching composition of this invention.

The invention has been described in detail with particular reference to preferred embodiments thereof, but it will be understood that variations and modifications can be effected within the spirit and scope of the invention.

I claim:

1. A photographic bleaching composition comprising:

a) at least 0.01 mol/l of a bleaching agent that comprises ferric ion chelated with a first chelating ligand comprising an aromatic nitrogen heterocycle, and b) at least 0.01 mol/l of an organic amine base, said bleaching composition being substantially free of inorganic bases and the molar ratio of said organic amine base to said first chelating ligand being at least 1:1, said organic amine base is ethanolamine, triethanolamine, ethylenediamine, diethylamine, triethylamine, morpholine, tetramethylethylenediamine, piperazine, diethanolamine or 2-methylaminoethanol.

2. The composition of claim 1 wherein said bleaching agent comprises ferric ion chelated only with said first chelating ligand.

3. The composition of claim 1 that is a bleach-fixing composition that further comprises a photographic fixing agent.

4. The composition of claim 1 wherein said first ligand is represented by the following structure I or II:

(I)

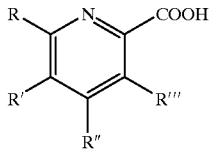

and (II)

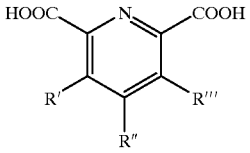

wherein R, R', R" and R'" are independently hydrogen, a substituted or unsubstituted alkyl of 1 to 5 carbon atoms, substituted or unsubstituted aryl group of 6 to 10 carbon atoms, a substituted or unsubstituted cycloalkyl of 5 to 10 carbon atoms, hydroxy, nitro, sulfo, amino, carboxy, sulfamoyl, sulfonamido, phospho or halo (such as chloro or bromo), or any two of R, R', R" and R'" can comprise the carbon atoms necessary to form a substituted or unsubstituted 5 to 7-membered ring fused with the pyridinyl nucleus.

5. The composition of claim 4 wherein R, R', R" and R'" are independently hydrogen, hydroxy or carboxy.

6. The composition of claim 1 wherein said first chelating ligand is unsubstituted 2-pyridinecarboxylic acid or 2,6-pyridinedicarboxylic acid.

7. The composition of claim 1 wherein said organic amine base has a water solubility of at least 0.01 mol/l.

8. The composition of claim 1 wherein said organic amine base is ethanolamine, diethanolamine or triethanolamine.

9. The composition of claim 8 wherein said organic amine base is ethanolamine.

10. The composition of claim 1 wherein said bleaching agent is present in an amount to provide ferric ions in an amount of from about 0.01 to about 1 mol/l, and said organic amine base is present in an amount of from about 0.01 to about 3 mol/l.

11. The composition of claim 1 further comprising rehalogenating agent or buffer, or both.

12. The composition of claim 1 wherein said bleaching agent comprises ferric ion chelated with said first chelating ligand and a second chelating ligand, the molar ratio of said first chelating ligand to ferric ion being from about 0.6:1 to about 2:1, and the molar ratio of said second chelating ligand to ferric ion being from about 0.2:1 to about 2:1.

13. The composition of claim 12 wherein said second chelating ligand is a biodegradable aminopolycarboxylic acid or polycarboxylic acid chelating ligand.

14. The composition of claim 13 wherein said second chelating ligand is an iminodiacetic acid or a derivative thereof, an aminodisuccinic acid, an aminomonosuccinic acid, alaninediacetic acid, β-alaninediacetic acid, nitrilotriacetic acid, glycinesuccinic acid, 2-pyridylmethyliminodiacetic acid, tartaric acid or citric acid.

15. The composition of claim 13 wherein said second chelating ligand is represented by Structure III or IV:

III

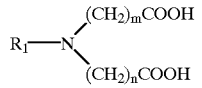

wherein m and n are independently 1, 2 or 3, $R_1$ is hydrogen, a substituted or unsubstituted alkyl group, a substituted or unsubstituted aryl group, or a substituted or unsubstituted heterocyclic group having from 5 to 10 carbon and heteroatoms,

IV

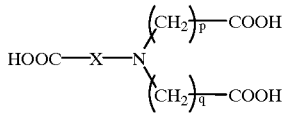

wherein p and q are independently 1, 2 and 3, the linking group X is any divalent group that does not bind ferric ion and does not cause the resulting ligand to be water-insoluble.

16. The composition of claim 15 wherein said second chelating ligand of Structure III is:

1

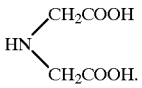

2

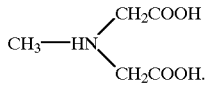

3

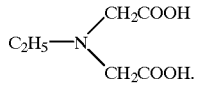

4

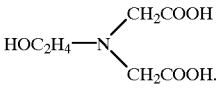

5

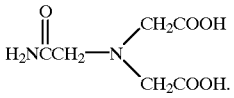

6

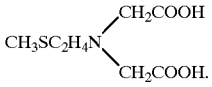

7

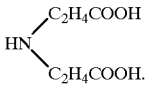

8

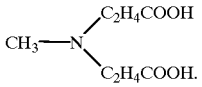

9

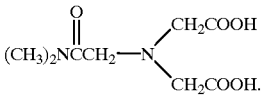

and said second chelating ligand of Structure IV is:

1

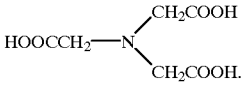

2

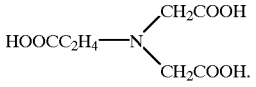

3

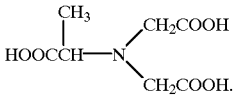

4

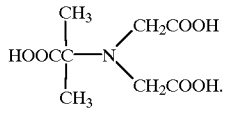

5

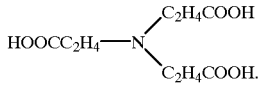

6

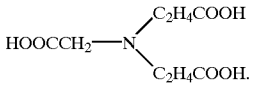

17. The composition of claim 13 wherein said aminopolycarboxylic acid chelating ligand is methyliminodiacetic acid, iminodiacetic acid, ethyliminodiacetic acid or nitrilotriacetic acid.

18. A photographic bleaching composition comprising:

a) at least 0.1 mol/l of a bleaching agent that comprises ferric ion chelated with a first chelating ligand that is unsubstituted 2-pyridinecarboxylic acid or 2,6-pyridinedicarboxylic acid, and a second chelating ligand that is methyliminodiacetic acid or nitrilotriacetic acid, the molar ratio of said first chelating ligand to ferric ion being from about 0.8:1 to about 2:1, and the molar ratio of said second chelating ligand to ferric ion being from about 0.5:1 to about 2:1, and b) at least 0.1 mol/l of ethanotamine, diethanolamine or triethanolamine, or a mixture of any of these, said bleaching composition being substantially free of inorganic bases and the molar ratio of ethanolamine, diethanolamine or triethanolamine, or a mixture of any of these, to said second chelating ligand being at least 1:1.

19. The composition of claim 18 wherein said second chelating ligand is nitrilotriacetic acid, and said organicamine base is ethanolamine.

20. A method of photographic processing comprising bleaching an imagewise exposed and color developed photographic silver halide element with the bleaching composition of claim 1.

21. The method of claim 20 wherein said photographic silver halide element is a color reversal photographic silver halide film.

* * * * *